US006946988B2

(12) United States Patent
Edwards et al.

(10) Patent No.: US 6,946,988 B2
(45) Date of Patent: Sep. 20, 2005

(54) DETACHABLE REMOTE CONTROLLER FOR AN ELECTRONIC ENTERTAINMENT DEVICE AND A METHOD FOR USING THE SAME

(75) Inventors: Bruce Edwards, Burlingame, CA (US); Craig M. Janik, Los Altos Hills, CA (US); Scott Summit, San Francisco, CA (US)

(73) Assignee: Simple Devices, San Mateo, CA (US)

( * ) Notice: Subject to any disclaimer, the term of this patent is extended or adjusted under 35 U.S.C. 154(b) by 430 days.

(21) Appl. No.: 10/053,015

(22) Filed: Nov. 9, 2001

(65) Prior Publication Data

US 2002/0167696 A1 Nov. 14, 2002

Related U.S. Application Data

(60) Provisional application No. 60/247,259, filed on Nov. 10, 2000.

(51) Int. Cl.[7] ..... G09G 1/00

(52) U.S. Cl. ..... 341/176; 340/825.72; 345/169

(58) Field of Search ..... 341/176; 345/169, 345/158; 340/825.72; 348/734; 235/462.46, 472.02; 255/473, 462.95

(56) References Cited

U.S. PATENT DOCUMENTS 4,450,487 A 5/1984 Koide
5,486,852 A 1/1996 Arai

FOREIGN PATENT DOCUMENTS

EP 0 899 889 A2 3/1999

*Primary Examiner*—Michael Horabik
*Assistant Examiner*—Hung Dang
(74) *Attorney, Agent, or Firm*—Gary R. Jarosik

(57) ABSTRACT

A detachable remote controller for an electronic entertainment device and a method for using the same are provided. The detachable remote controller includes a first infrared transmitter and a second infrared transmitter. The first infrared transmitter transmits signals to the electronic device while the detachable remote controller is coupled with the entertainment device. The remote controller is shaped in such a way to be docked within a cavity and flush with one surface of the entertainment device. The first infrared transmitter is aligned in the cavity such that the first infrared transmitter transmits signals to a light pipe embedded within the entertainment device. The second infrared transmitter is located at one end of the detachable remote controller to transmit signals to the entertainment device while the detachable remote controller is not coupled with the entertainment device.

16 Claims, 9 Drawing Sheets

DETACHABLE REMOTE CONTROLLER FOR AN ELECTRONIC ENTERTAINMENT DEVICE AND A METHOD FOR USING THE SAME

RELATED APPLICATIONS

This application claims the benefit of the filing date of the following U.S. Patent Application:

U.S. Provisional Patent Application No. 60/247,259, titled "Detachable Remote Control For Electronic Entertainment Devices", and filed on Nov. 10, 2000.

FIELD OF THE INVENTION

The present invention relates generally to ubiquitous computing devices and, more particularly, to a detachable remote controller.

BACKGROUND

The convenience afforded by the use of infra-red (IR) remote controllers to control a wide range of audio-visual (A/V) equipment has made remote controllers ubiquitous. The majority of A/V consumer electronics devices, such as televisions, stereo receivers, CD-ROM changers, analog and digital set-top boxes, and VCRs, are sold with infra-red (IR) remote controllers. These remote controllers often include a completely redundant set of controls and interface elements that are included on the main housing of these devices. Some devices, such as televisions, include only a minimal set of control features on the main device, with the majority of control features on the remote controllers. Additionally, many portable and mobile audio-visual devices, such as portable video cameras and CD-ROM players, and car stereos, are also provided with remote controllers.

The multitude of remote controllers that accumulate in the household audio-visual center has driven the development of universal remote controllers, which are programmable modal devices that eliminate the need to switch from one remote controller to another when operating an A/V system that consists of multiple discrete devices. Therefore, in many situations, the use of the remote controllers that have been included with a specific electronic device is limited.

There is also inefficiency in creating redundant control function hardware and computer processing sub-systems, such as keypad scanning sub-systems, which adds cost to the electronic device. As consumer electronics is a highly price competitive market, device manufacturers are motivated to reduce the bill of materials of a given device, enabling either higher profit margin or a reduced price to the end user.

What is needed is providing a remote controller function without the redundancy of including two complete sets of interface elements in an electronic device.

SUMMARY OF THE INVENTION

A detachable remote controller for an electronic entertainment device and a method for using the same are provided. The detachable remote controller includes a first infrared transmitter and a second infrared transmitter. The first infrared transmitter transmits signals to the electronic device while the detachable remote controller is coupled with the entertainment device. The remote controller is shaped in such a way to be docked within a cavity and flush with one surface of the entertainment device. The first infrared transmitter is aligned in the cavity such that the first infrared transmitter transmits signals to a light pipe embedded within the entertainment device. The second infrared transmitter is located at one end of the detachable remote controller to transmit signals to the entertainment device while the detachable remote controller is not coupled with the entertainment device.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

A detachable remote controller for an electronic entertainment device and a method for using the same are described. In the following description, for purposes of explanation, numerous specific details are set forth in order to provide a thorough understanding of the present invention. It will be apparent, however, to one skilled in the art that the present invention can be practiced without these specific details. In other instances, well-known structures and devices are shown in block diagram form in order to avoid obscuring the present invention.

The detachable remote controller relates to a variety of electronic devices that typically include rectilinear enclosures consisting of plastic or sheet metal components. The electronic device 1 in one embodiment is shown as a generic shape with an LED display on the front. Examples of electronic devices for which the detachable remote controller can implemented are multiple disk CD-ROM changers, stereo receivers, VCRs, cable set-top boxes, and the like. The detachable remote controller may also be utilized with other electronic entertainment devices not limited to those discussed herein. The method for attaching the detachable remote controller to this device could easily be extended to most electronic devices even though they come in a variety of shapes, sizes and designs.

Figure 1:
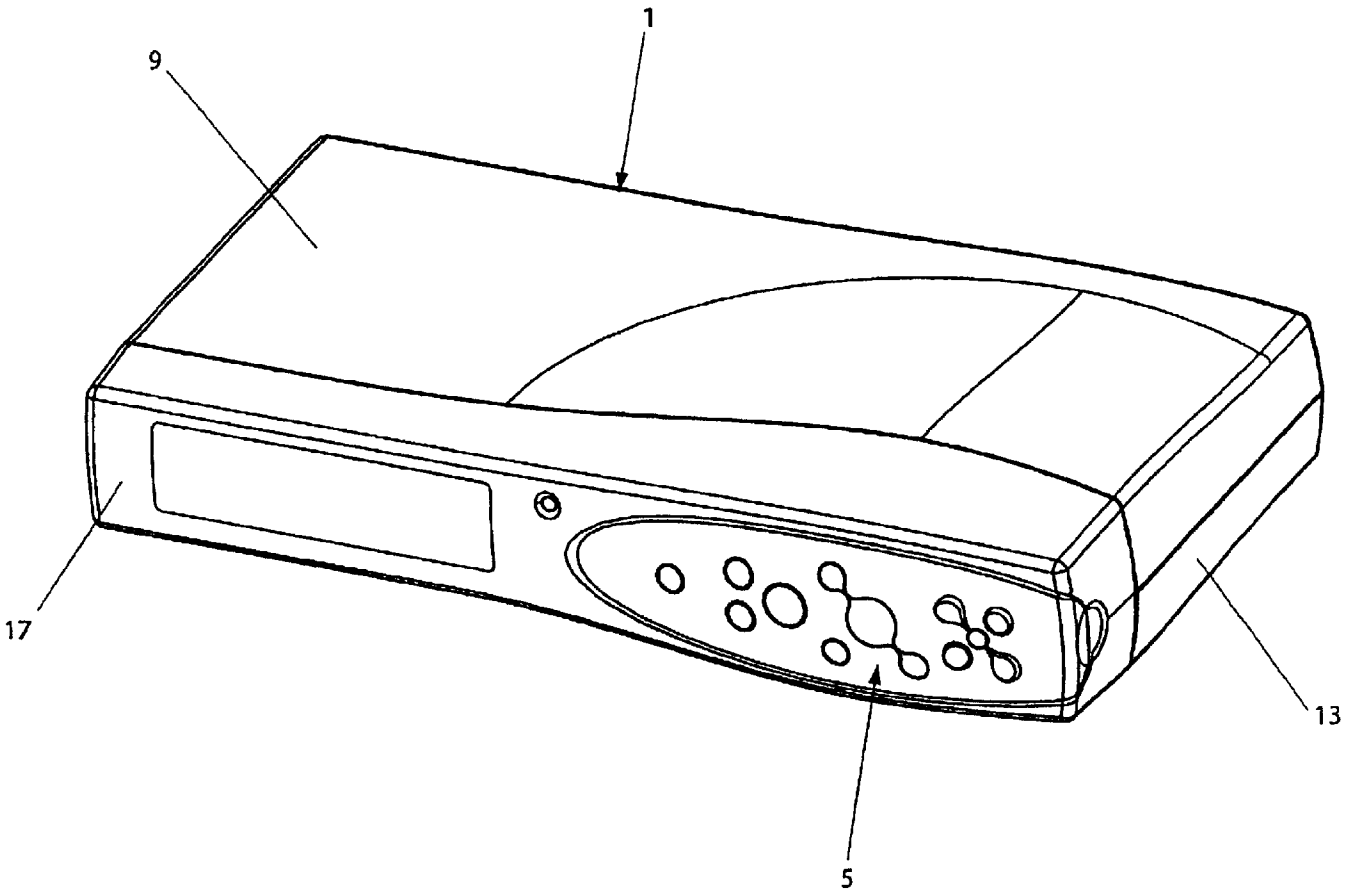
FIG. 1. shows an isometric view of one embodiment of a detachable remote controller docked with an electronic device.

FIG. 1 shows an isometric view of one embodiment of a detachable remote controller 5 docketed with electronic device 1. Electronic device 1 includes an injection-molded plastic top enclosure 9 and bottom enclosure 13 into which printed circuit boards and other electronic components may be fastened. Electronic device 1 includes a front plate known as a bezel 17 that includes button assemblies, displays, jacks, etc. Bezel 17 may be made of injection-molded plastic.

Figure 2:
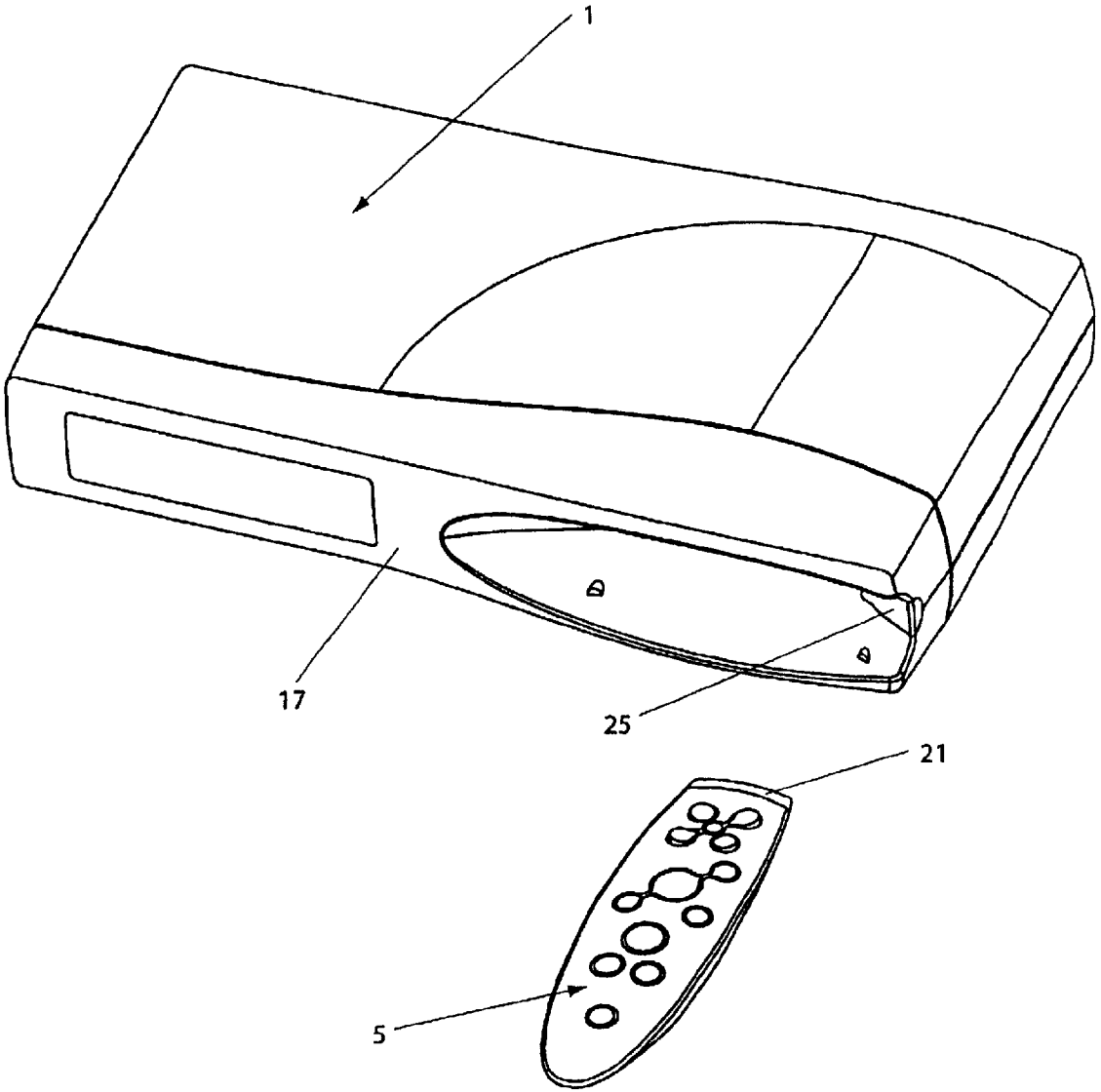
FIG. 2. shows an isometric view of one embodiment of a detachable remote controller removed from an electronic device.
Figure 3:
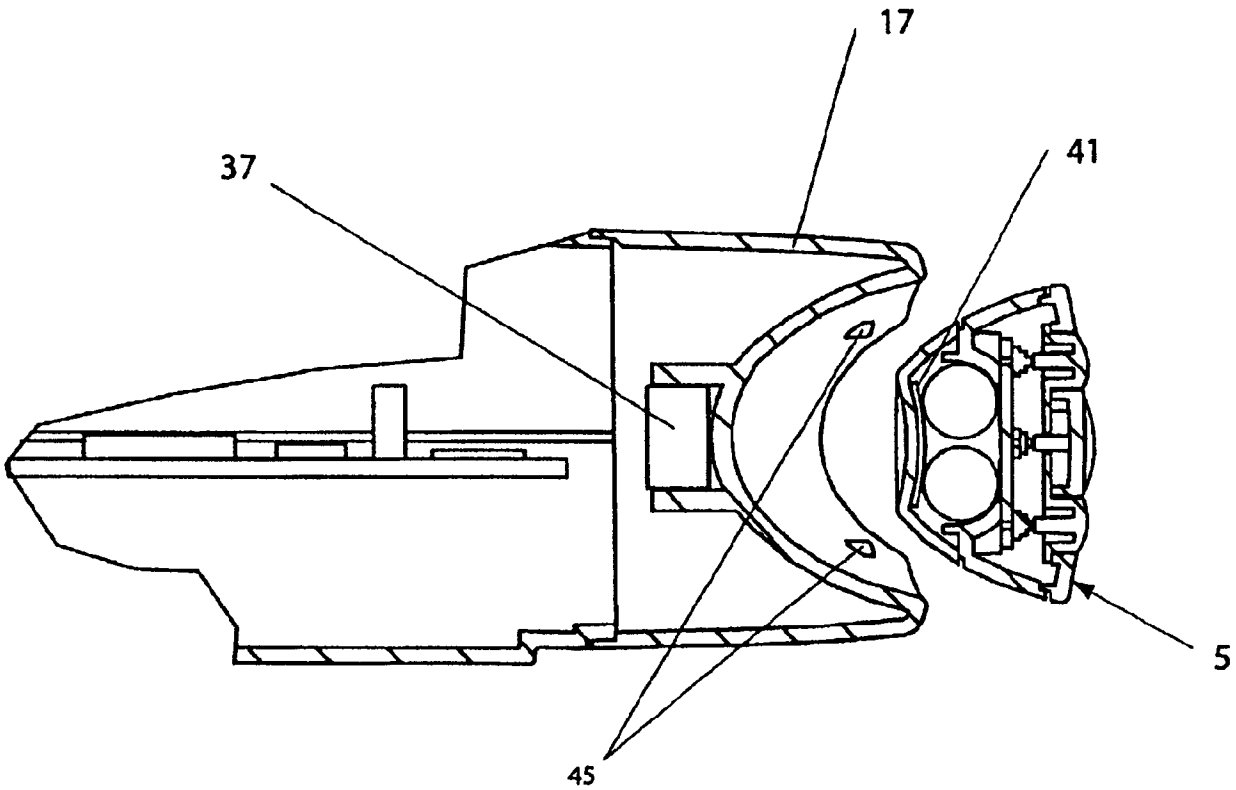
FIG. 3. shows one embodiment of a detachable remote controller having locator pins and magnets to attach the remote controller to the cavity in the device housing.

FIG. 2 shows an isometric view of one embodiment of a detachable remote controller 5 removed from an electronic device 1, exposing a remote controller cavity 49 that is molded into bezel 17. Detachable remote controller 5 attaches to electronic device 1 by sliding into cavity 49. FIG. 3 shows one embodiment of a detachable remote controller 5 having locator pins 45 and magnets 37 to attach the remote controller 5 to the cavity 49 in the device housing. FIG. 3 also shows a section view of the cavity shape. Detachable remote controller 5 includes a plastic injection-molded enclosure that contains electronic components functionally connected by a printed circuit board, batteries, buttons, and other hardware integral to the operation of detachable remote controller 5. Buttons protrude through the top of the detachable remote controller enclosure. Since detachable remote controller 5 can be designed to accommodate a host of button configurations, FIG. 2 depicts a generic button format. The remote controller includes a microcontroller with a remote IR (infrared) transceiver 29 located at the front of the device, covered by a remote lens 21. On electronic device 1, there is also an IR lens behind which, there is another IR transceiver. Both remote lens 21 and device lens 25 may be injection-molded out of transparent polycarbonate plastic. Remote IR transceiver 29 is used to send pulses of IR light that constitute a communication signal. These pulses of light travel through remote lens 21 and device lens 25 and are detected by device IR transceiver 33 located in electronic device 1. Electronic components in combination with firmware further interprets these signals and uses them to control the performance of the electronic device 1.

In one embodiment, detachable remote controller 5 is attached to electronic device 1 by the use of a strong (rare earth) magnet 37. As shown in FIG. 3, magnet 37 is attached to the plastic on the inside of bezel 17. A metallic plate 41 is located in detachable remote controller 5 on the inside surface of the bottom surface of detachable remote controller 5. Pins 45 are located in cavity 49 of bezel 17, and complementary sockets are located on the bottom of detachable remote controller 5. When detachable remote controller 5 is placed in the vicinity of cavity 49 in electronic device 1, the magnetic field inherent to magnet 37 attracts metallic plate 41, and detachable remote controller 5 is securely fastened inside cavity 49 with pins 45 mated into sockets. The strength of the magnetic field is such that a user can easily pull detachable remote controller 5 away from electronic device 1. Additionally, detachable remote controller 5 is restrained from up, down or side to side motion by the mated pin and socket interface.

Figure 4:
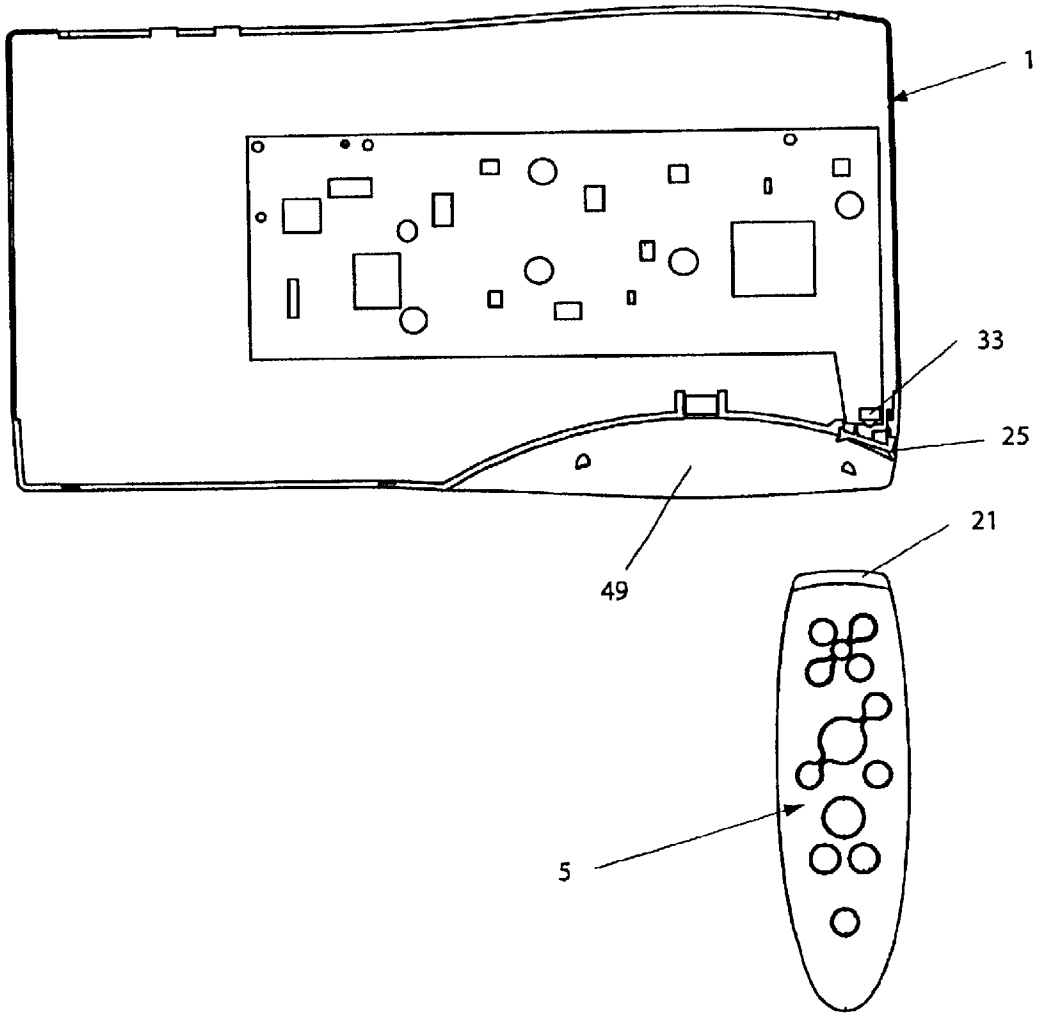
FIG. 4. shows a top view of one embodiment of a detachable remote controller pointed toward electronic device with device top enclosure removed exposing the location of the device IR transmitter.

FIG. 4 shows a top view of one embodiment of a detachable remote controller 5 pointed toward electronic device 1 with device top enclosure 9 removed exposing the location of the deice IR transceiver 33. FIG. 4 also shows the positioning of device IR transceiver relative to device lens 25.

Alternative Communication Embodiment—Metal Contacts

Figure 5:
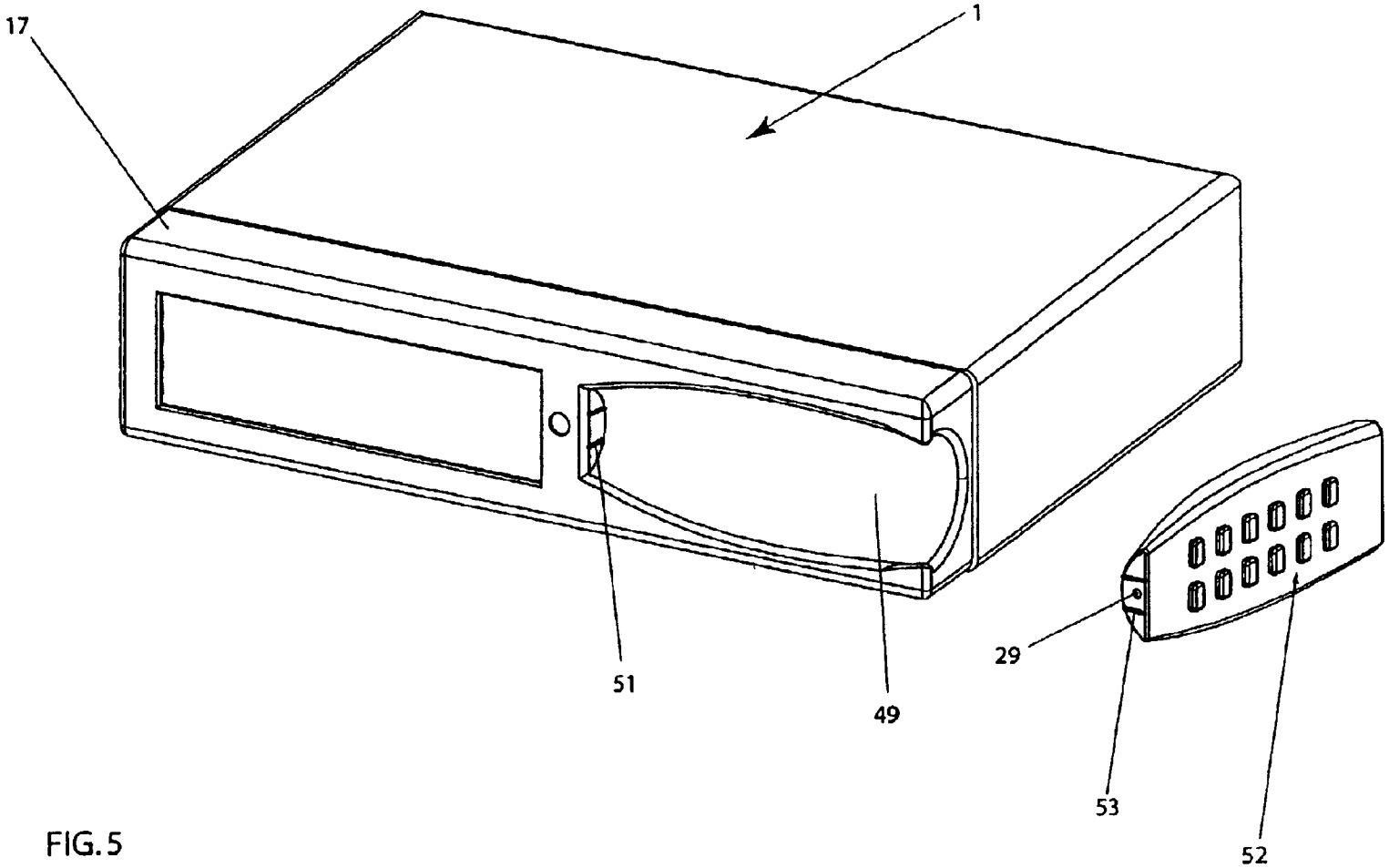
FIG. 5. shows one embodiment of the detachable remote controller where metal contacts are used to establish communication between the device and docked remote controller.

FIG. 5 shows one embodiment in which a metal tab remote controller 52 has exposed metal tabs 53 that establish physical contact with metal contacts 51 located in cavity 49, so that a physically wired communication line is established between metal tab remote controller 52 and electronic device 1 when the metal tab remote controller 52 is docked. Metal tab remote controller 52 still includes remote controller IR transceiver 29 for use when the remote controller is used away from electronic device 1.

Alternative Communication Embodiment—Remote Controller with Two IR Emitters

Figure 6:
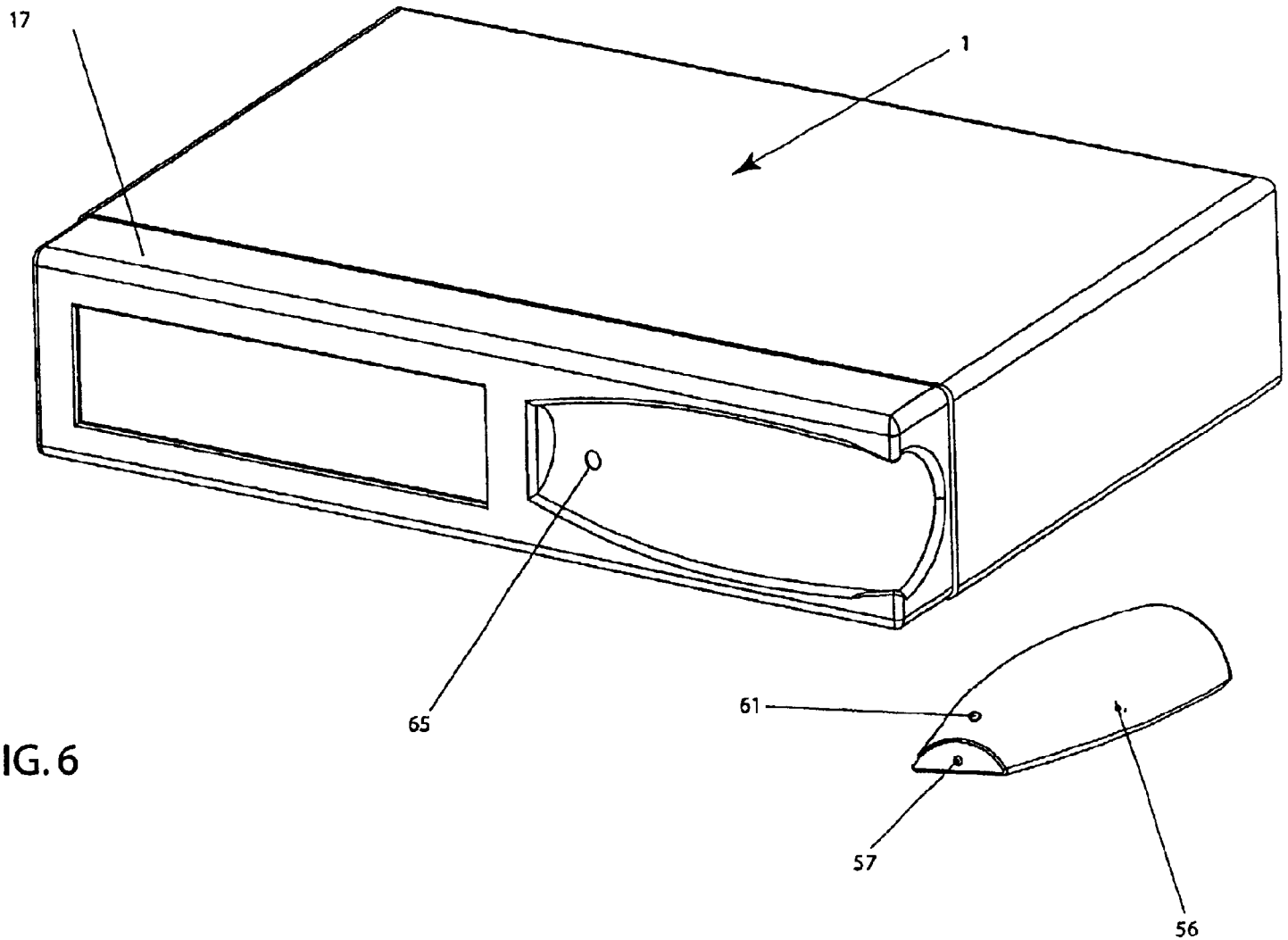
FIG. 6. shows one embodiment of the detachable remote controller where the remote controller has two IR transmitters.

FIG. 6 shows an embodiment of the invention in which the remote controller 56 has two IR transceivers. In one embodiment, the two IR transceivers are at right angles to one another—a front remote controller IR transceiver 57 and a bottom remote controller IR transceiver 61. Electronic device only has one IR detection panel 65 mounted in cavity 49. Communication signals are transmitted identically to both remote controller IR transceivers. When remote controller 56 is detached and is being used remotely, front remote controller IR transceiver 57 will be used to point at IR detection panel 65 to transfer data. When remote controller 56 is docked with electronic device 1, bottom remote controller IR transceiver 61 will be the IR transmitter that communicates with IR detection panel 65. In this way, electronic device 1 only receives IR input signals from one remote controller transceiver.

Alternative Embodiments—Angled Four-way Control Buttons

Figure 7:
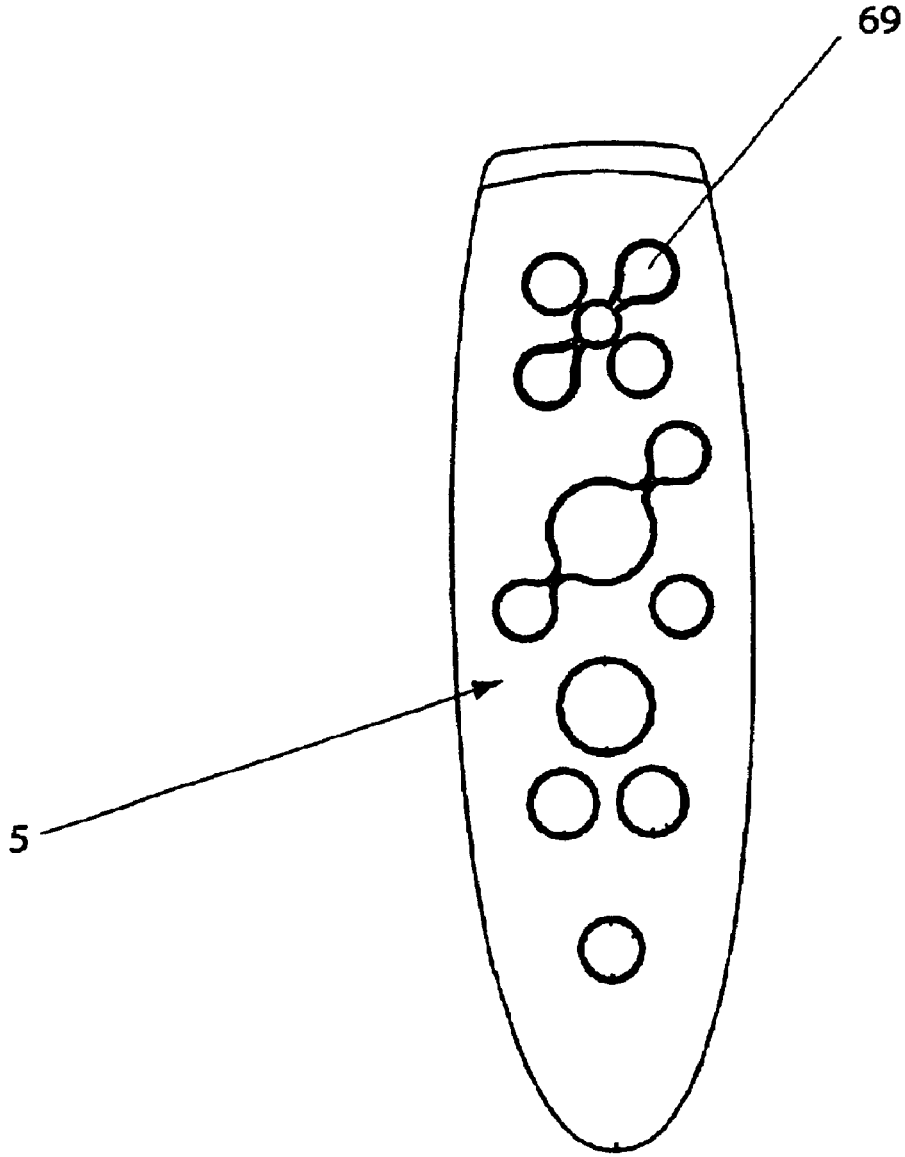
FIG. 7. shows one embodiment of the detachable remote controller where the remote controller has a four-way button navigation set fixed at 45 degrees.
Figure 8:
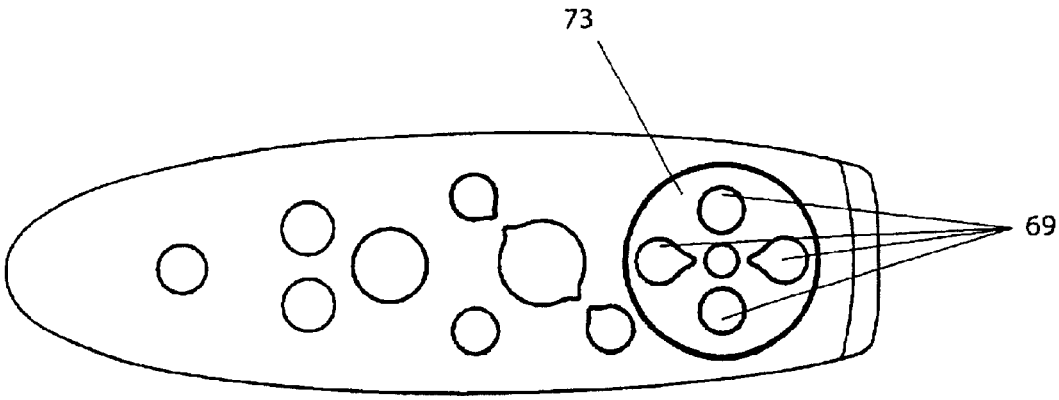
FIG. 8. shows one embodiment of the detachable remote controller where the remote controller has a turret mounted four-way button navigation set oriented for use in the electronic device.
Figure 9:
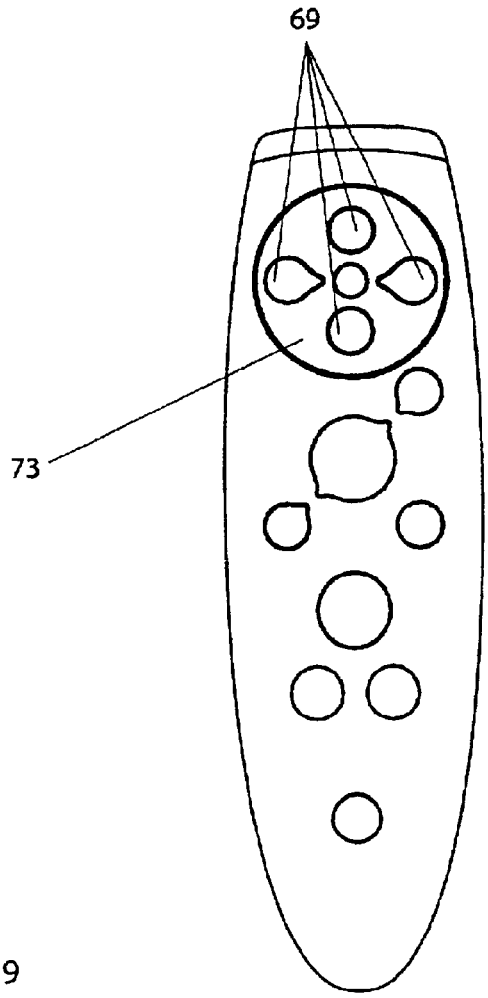
FIG. 9. shows one embodiment of the detachable remote controller where the remote controller has a turret mounted four-way button navigation set oriented for use while removed from the electonic device.

FIG. 7 through FIG. 9 shows detachable remote controller 5 that includes a four-way navigation button set 69. Four-way navigation button set 69 are used on consumer electronic devices where graphical user interfaces are provided that allow manipulation of graphical elements in two dimensions. In one embodiment shown in FIG. 7, four-way navigation button set 69 is fixed at a 45-degree angle on detachable remote controller 5, so that it can be used when detachable remote controller 5 is attached to electronic device 1, and when detachable remote controller 5 is removed and used pointed toward electronic device 1.

In another embodiment, four-way navigation button set 69 is implemented in a rotatable plastic turret 73. FIG. 8 shows rotatable plastic turret 73 oriented so that four-way navigation button set can be used appropriately in electronic device 1. FIG. 9 shows rotatable plastic turret 73 rotated 90 degrees, so that the navigation buttons can be used properly when out of electronic device 1.

In one embodiment cavity 49 is designed with an overhang profile and works in such a way that detachable remote controller 5 can slide into place but cannot be maneuvered perpendicular to the direction that it slides. In this way, the user can easily attach (slide in), or detach (slide out) the remote controller, but in the absence of an external force other than gravity the remote controller will remain in place within cavity 49 of electronic device 1.

Alternative Embodiment—Spring-loaded Slide Latch

Figure 10:
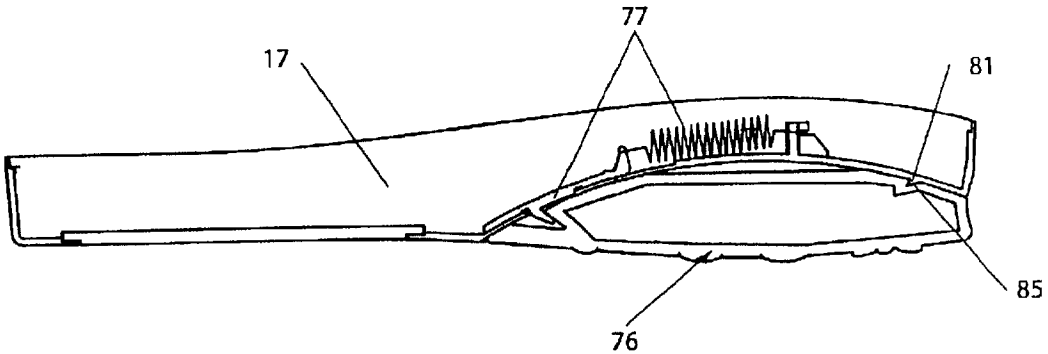
FIG. 10 shows a top view of one embodiment of the detachable remote controller where a spring-loaded slide latch system is used to secure the remote controller to the cavity of the device housing.
Figure 11:
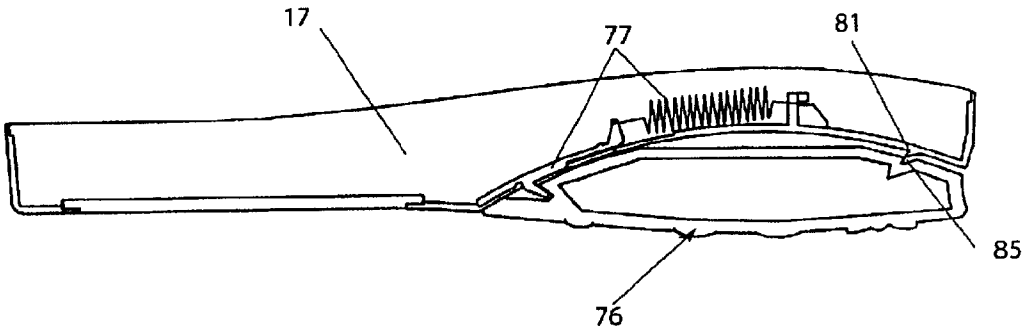
FIG. 11 shows a top view of one embodiment of the detachable remote controller where the remote controller is pulled out from the electronic device and clear of a restraining hook.
Figure 12:
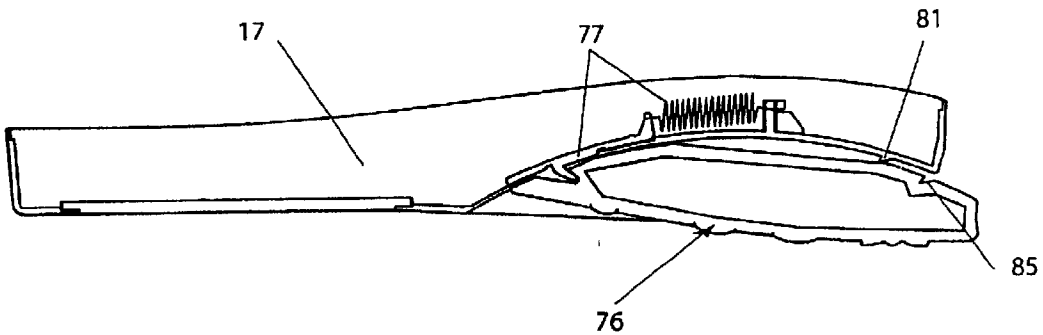
FIG. 12 shows a top view of one embodiment of the detachable remote controller where the remote controller is in a presentation position.

In another embodiment shown in FIG. 10 through FIG. 12, a spring-loaded slide latch system 77 is used to attach detachable remote controller 5 to electronic device 1. While installed in electronic device 1, slide latch remote controller 76 is engaged with spring-loaded slide system 77. The spring force imparted by spring-loaded slide latch system 77 brings a restraining hook receptacle 85 of slide latch remote controller 76 to bare on a restraining hook 81 that is molded into cavity 49. Caught between spring-loaded slide latch system 77 and restraining hook 81, slide latch remote controller 76 is held securely in place. When slide latch remote controller 76 is slid to the left and it's right edge is pulled forward, slide latch remote controller 76 comes clear of restraining hook 31. Spring loaded slide system pushes slide latch remote controller 76 to the right so that slide latch remote controller 76 is presented to user for grasping, but is still retained against cavity 49.

FIG. 10 shows a top view of a one embodiment of the detachable remote controller where a spring-loaded slide latch system is attached to electronic device 1. FIG. 11 shows a top view of one embodiment of the detachable remote controller 76 where the remote controller 76 is pulled out from the electronic device 1 and clear of a restraining hook 81. FIG. 12 shows one embodiment of the detachable remote controller where a slide latch remote controller 76 is in the presentation position, presented to user for grasping.

Alternative Embodiment—Light Pipe Used to Transmit IR Signal

In another embodiment a light pipe feature is integral to device lens 25. A light pipe functions on the same principle as fiber optic cable, that is, light is transmitted through an optically clear physical medium, so it can be redirected without changing the signal. The light pipe integral to device lens 25 is positioned at the rear of cavity 49 and is in close proximity to remote controller lens 21 and remote controller IR transceiver 29 when detachable remote controller 5 is docked in cavity 49.

In this way, IR signals transmitted by detachable remote controller 5 can be redirected to device IR transceiver 33, and related circuitry in the device that will interpret the signal and control electronic device 1. Thus, detachable remote controller 5 can be used to control electronic device 1 when it is docked in cavity 49 against electronic device 1, as well as when detachable remote controller 5 is detached and use within several feet of electronic device 1.

A detachable remote controller for an electronic entertainment device and a method for using the same have been described. Although the present invention is described herein with reference to specific embodiments, many modifications and variations therein will readily occur to those with ordinary skill in the art. Accordingly, all such variations and modifications are included within the intended scope of the present invention as defined by the following claims.

What is claimed is:

1. A detachable remote controller comprising:

a housing;

the housing shaped to allow for docking within a cavity in an electronic entertainment device and flush with a surface of the electronic entertainment device;

a first and second infrared transmitter;

the first infrared transmitter disposed within the housing to transmit signals to the electronic entertainment device while the housing is docked within the cavity of the electronic entertainment device;

the first infrared transmitter positioned in the housing and aligned in the cavity to enable the first infrared transmitter to transmit signals to a light pipe embedded within the entertainment device; and the second infrared transmitter disposed at one end of the housing to transmit signals to the electronic entertainment device while the housing is not docked within the cavity of the electronic entertainment device.

2. The detachable remote controller of claim 1 further comprising exposed metal contacts to physically contact corresponding metal tabs on the electronic entertainment device while the housing is docked within the cavity of the electronic entertainment device so that a wired communication line is established between the housing and the electronic entertainment device.

3. The detachable remote controller of claim 1 further comprising a set of control buttons to trigger specified signals to be transmitted by both the first and second infrared transmitters.

4. The detachable remote controller of claim 3 wherein the set of control buttons correspond to functions of the electronic entertainment device that are triggered exclusively by the control buttons of the remote controller.

5. A detachable remote controller for detachably coupling with an electronic entertainment device, comprising:

a housing;

the housing shaped to allow for docking within a cavity in an electronic entertainment device and flush with a surface of the electronic entertainment device;

a first infrared transmitter disposed within the housing to transmit signals to the electronic entertainment device while the housing is docked within the cavity of the electronic entertainment device; and the first infrared transmitter positioned in the housing and aligned in the cavity to enable the first infrared transmitter to transmit signals to a light pipe embedded within the electronic entertainment device.

6. The detachable remote controller of claim 5 further comprising a second infrared transmitter disposed at an end of the housing to transmit signals to the electronic entertainment device when the housing is not coupled with the electronic entertainment device.

7. The detachable remote controller of claim 5 further comprising a set of control buttons to trigger specified signals to be transmitted by both the first and second infrared transmitters.

8. The detachable remote controller of claim 7 wherein the set of control buttons correspond to functions of the electronic entertainment device that are triggered exclusively by the control buttons of the remote controller.

9. A detachable remote controller comprising:

a housing;

the housing shaped to allow for docking within a cavity in an electronic entertainment device and flush with a surface of the electronic entertainment device;

an infrared transmitter disposed at one end of the housing to transmit signals to the electronic entertainment device while the housing is not docked within the electronic entertainment device; and exposed metal contacts disposed on the housing to physically contact corresponding metal tabs on the electronic entertainment device while the housing is docked within the cavity and flush with the surface of the electronic entertainment device to enable a wired communication line between the housing and the electronic entertainment device.

10. The detachable remote controller of claim 9 further comprising a set of control buttons to trigger specified signals to be transmitted by the infrared transmitter.

11. The detachable remote controller of claim 10 wherein the set of control buttons correspond to functions of the electronic entertainment device that are triggered exclusively by the control buttons of the remote controller.

12. A system comprising:

an electronic entertainment device having a cavity and a light pipe, the light pipe embedded within the electronic entertainment device; and a detachable remote controller detachably coupled with the electronic entertainment device such that the remote controller is docked within the cavity and flush with a surface of the entertainment device, the detachable remote controller including a first infrared transmitter to transmit signals from the remote controller to the entertainment device while the remote controller is docked within the cavity of the entertainment device, the first infrared transmitter optically aligned with the light pipe to enable the first infrared transmitter to transmit signals to the light pipe embedded within the electronic entertainment device.

13. The system of claim 12 further comprising a second infrared transmitter disposed at an end of the detachable remote controller to transmit signals to the electronic entertainment device when the detachable remote controller is not coupled with the electronic entertainment device.

14. The system of claim 12 further comprising exposed metal contacts disposed on the detachable remote controller to physically contact corresponding metal tabs on the electronic entertainment device while the detachable remote controller is docked within the cavity of the electronic entertainment device so that a wired communication line is established between the detachable remote controller and the electronic entertainment device.

15. The system of claim 12 further comprising a set of control buttons to trigger specified signals to be transmitted by both the first and second infrared transmitters.

16. The detachable remote controller of claim 15 wherein the set of control buttons correspond to functions of the electronic entertainment device that are triggered exclusively by the control buttons of the remote controller.

* * * * *